US005359919A

United States Patent [19]

Beyer

[11] Patent Number: 5,359,919

[45] Date of Patent: Nov. 1, 1994

[54] METHOD OF CONFINEMENT OF PROPELLANTS FOR IGNITION

[75] Inventor: Richard A. Beyer, Baltimore, Md.

[73] Assignee: The United States of America as represented by the Secretary of the Army, Washington, D.C.

[21] Appl. No.: 17,092

[22] Filed: Feb. 10, 1993

[51] Int. Cl.[5] ..... F41A 1/04

[52] U.S. Cl. ..... 89/7; 102/202

[58] Field of Search ..... 86/20.12; 89/7; 102/200, 201, 202, 202.5, 328, 329, 330, 440

[56] References Cited

U.S. PATENT DOCUMENTS 3,528,372 9/1970 Lewis et al. ..... 102/210
3,759,183 9/1973 Apstein ..... 102/202.5

OTHER PUBLICATIONS

Twenty-First Symposium (International) on Combustion/ The Combustion Institute Plasma Propellant Jet Ignition, by F. B. Carleton, et al, 1986, pp. 1885–1890.
Memorandum Report BRL-MR-3748, Electrical Ignition of LGP 1846 in a Two Stage Igniter, by James DeSpirito, et al, Apr. 1989.

*Primary Examiner*—Stephen C. Bentley
*Attorney, Agent, or Firm*—Freda L. Krosnick; Muzio B. Roberto; Walter R. Baylor

[57] ABSTRACT

A method for confinement of a gun propellant during the initial stage of ignition provides the ignition by electrical, pyrotechnic, or laser irradiation means. A liquid and or a solid propellant is placed in a substantially closed chamber. A portion of the propellant in a conduit of the chamber exits from the chamber and is cooled in the exit conduit by a thermoelectric or cryogenic means to a sufficiently low temperature for producing a viscous, glassy, or substantially solidified condition to enhance the propellant containment. An ignition stimulus is then applied. A closure means in the exit conduit selectively varies the amount of flow whereby a relatively high temperature and pressure are reached from the chemical energy release of the propellant. Venting of the formed combustive products is provided through the exit conduit whereby sufficient thermal energy is generated to sustain combustion and to ignite the next stage.

23 Claims, 2 Drawing Sheets

METHOD OF CONFINEMENT OF PROPELLANTS FOR IGNITION

RIGHTS OF THE GOVERNMENT

The invention described herein may be manufactured, used, and licensed by or for United States Governmental purposes without payment to us of any royalty thereon.

BACKGROUND OF THE INVENTION

1. Field of Invention

The present invention relates to a method for the confinement of gun propellants during the initial stage of ignition, especially in small volume igniters. The invention allows temporary confinement of an initial small volume of liquid propellant up to a pressure of several thousand pounds per square inch. After robust ignition has taken place, the confinement is removed by the thermal energy released by the combustion, and the hot gases and burning propellant are released into a larger volume to ignite the propellant therein. This larger volume may be either the main charge of an intermediate ignition stage or the main propellant charge.

2. Discussion of the Prior Art

The liquid propellant which is proposed for gun applications has a characteristic which is similar to many other propellants. Such a propellant requires pressures substantially above ambient atmospheric pressure to achieve complete ignition. Guns using liquid propellants have previously addressed this problem by igniting a small volume (typically less than one milliliter) completely filled with propellant. The propellant self-pressurizes due to the start of decomposition and heating when energy is deposited into the propellant because it is confined in the chamber with only limited pressure relief through either a small diameter exit orifice or a long, narrow exit tube of somewhat larger diameter. Although previous studies have centered primarily on electrical ignition, and the present device has been demonstrated using laser ignition, the confinement requirement is present and probably similar in both cases.

In a prior art method, a small diameter, short length-to-diameter ratio orifice venting is based on the pioneering work of Felix Weinberg and his co-workers [for example, Carleton, et al., "Plasma Propellant Jet Ignition," 21st Symposium (International) on Combustion, The Combustion Institute, Pittsburgh, p. 1885, 1988]. This approach was modified by engineers in application to actual gun propellant because they found that the small orifice was too confining once ignition had taken place. They then developed a long tube "inertial" confinement which confines the propellant by using a length-to-diameter tube as the exit. This tube is initially filled with liquid at the same time as the small chamber; the inertia and viscosity of this liquid in the tube confines the material in the igniter section for a short period of time to allow for the required high pressurization. (for example, FIG. 1 in DeSpirito, et al., "Electrical Ignition of LGP 1856 in a Two-Stage Ignition," BRL Memorandum Report BRL-MR-3748, 1989).

However, the use of the long tube as an exit orifice in the second device described (DeSoirito, et al.) results in significant heat loss to the tube walls as well as the destruction of many of the highly reactive combustion species (radicals) that are the basis of the efficiency of Weinberg's device.

SUMMARY OF THE INVENTION

It is a primary object of the present invention to provide a method of initial confinement of a small amount of propellant during ignition, but also venting of combustive products through a high throughput exit orifice when sufficient thermal energy has been generated to sustain combustion and to ignite the next stage.

It is another object of the present invention to provide a method which completely confines the propellant with virtually no orifice, and thus, resulting in lower ignition threshold energies for some materials.

It is a further object to provide a method that utilizes a relatively large diameter, short length-to-diameter, exit orifice from the initial ignition volume to maximize the concentration and total quantity of highly reactive flame species in the hot flow.

These objects and others not specifically enumerated are accomplished by the method of the present invention for confinement of a gun propellant during the initial stage of ignition, which ignition is by electrical, pyrotechnic, or laser irradiation means. A liquid and or a solid propellant is placed in a substantially closed chamber. A portion of the propellant in a conduit exits from the chamber and is cooled in the exit conduit by a thermoelectric or cryogenic means to a sufficiently low temperature for producing a viscous, glassy, or substantially solidified condition to enhance the propellant containment. An ignition stimulus is then applied. A closure means in the exit conduit selectively varies the amount of flow whereby a relatively high temperature and pressure are reached from the chemical energy release of the propellant. Venting of the formed combustive products is provided through the exit conduit whereby sufficient thermal energy is generated to sustain combustion and to ignite in the next stage.

BRIEF DESCRIPTION OF THE DRAWINGS

The foregoing and other objects, aspects, uses, and advantages of the present invention will be more fully appreciated as the same becomes better understood when considered in connection with the following accompanying drawings, in which.

DESCRIPTION OF THE PREFERRED EMBODIMENT

Figure 1:
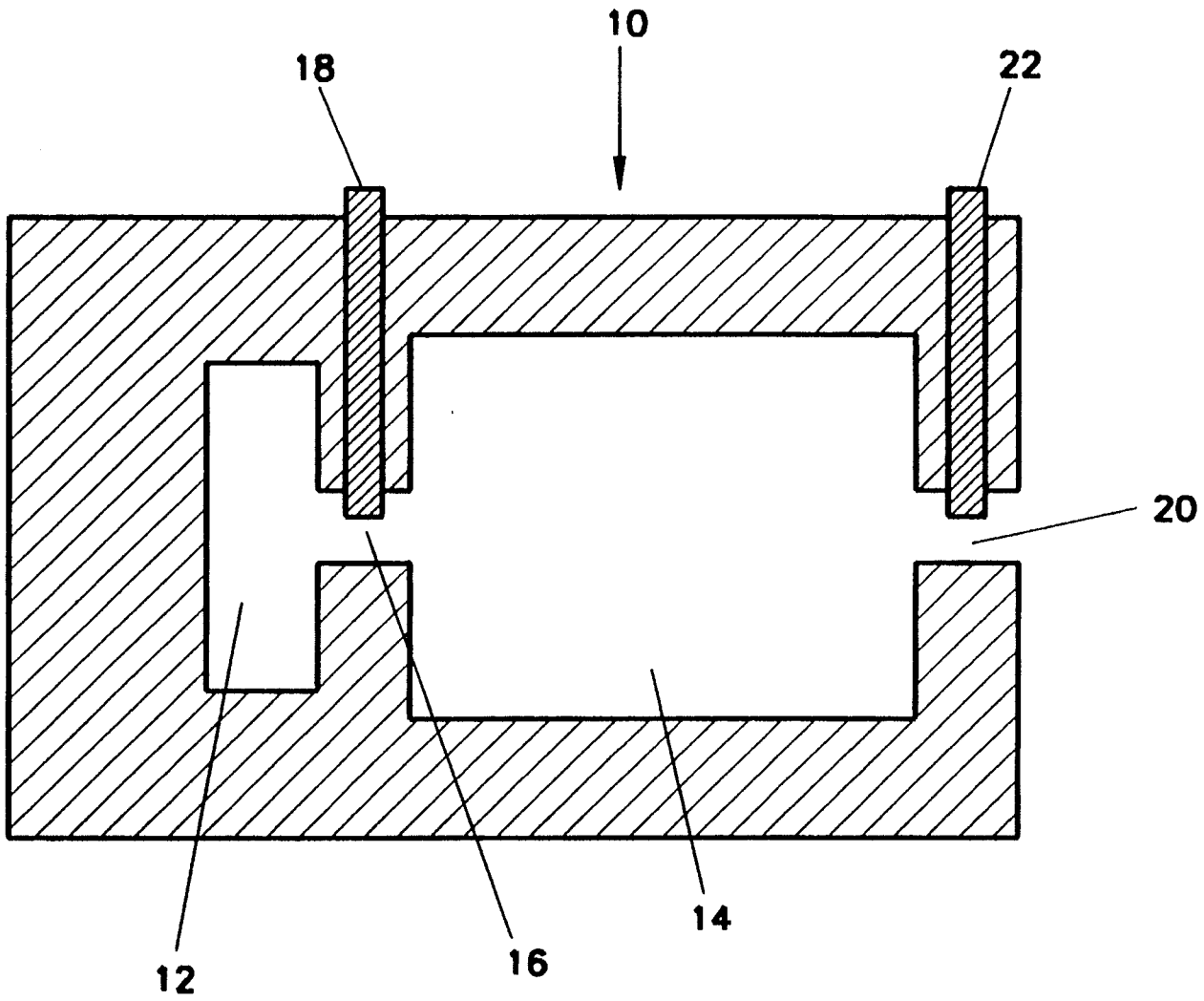
FIG. 1 is a cross-sectional side view of a liquid propellant igniter.

Referring now to the drawings, like reference numerals represent identical or corresponding parts throughout the several views.

FIG. 1 discloses an ignition device 10 which has a small, self-contained primary ignition chamber 12 and a secondary larger chamber 14. The primary chamber 12 and the secondary chamber 14 are connected by a connecting orifice 16. The primary chamber 12 provides for pressurization of the hot gases and other combustion products in order to ignite either a larger intermediate ignition stage or a main propellant charge. The entire interior volume of the primary chamber 12 is initially filled with a propellant material. The secondary chamber 14 is also partially or completely filled with the propellant. After the propellant is in place, cooling is applied to the propellant in the connecting orifice 16 through a first cold source 18. The cold source 18 is disclosed in FIG. 1 as a cryogenic or thermoelectric rod. The amount of cooling required for functioning will depend on the type of propellant used, whether the propellant needs to be only more viscous, glassy, or almost solidified, the specific orifice geometry, especially the profile and diameter, and the degree of pressure desired before release of combustion products into the next stage. When the propellant is sufficiently cold, an ignition source (not shown) is applied to the propellant in the primary chamber 12. This method is independent of the specific type of ignition such as electrical, pyrotechnic, and laser irradiation means that is used. The ignition starts the chemical reactions that release the propellant energy. If the chamber 12 cannot release the pressure generated from these chemical reactions through the orifice 16, the pressure in the chamber 12 rises rapidly and full ignition of the propellant in the chamber 12 is achieved. The highly viscous/glassy propellant in the orifice 16 effectively confines the propellant to the chamber 12 until either a sufficiently high pressure is achieved to push a plug (not shown) from the orifice 16 or enough heat is generated from combustion to sufficiently liquify the propellant material in the orifice 16 and allow venting into the secondary chamber 14 to achieve the robust high-pressure combustion that is required. An output orifice 20 of the secondary chamber 14 can be similarly restricted by a second cold source 22 if the design and circumstances require it. It is generally desirable that the orifices 16 and 20 be as large in diameter as possible once the pressurization has been held sufficiently long to achieve robust combustion, within the constraint, that venting does not depressurize completely and extinguish the propellant.

The method of confinement is equally applicable to solid materials, especially those designed for decreased ignition sensitivity in order to reduce vulnerability to accidental ignition. In that case, a separate liquid (for example, water) would be introduced for the sealing process. The total confinement and variable orifice would have the same benefits as with liquid propellants. In this case the extra liquid and cooling serve as a renewable, high pressure, fast opening, high throughput valve.

Figure 2:
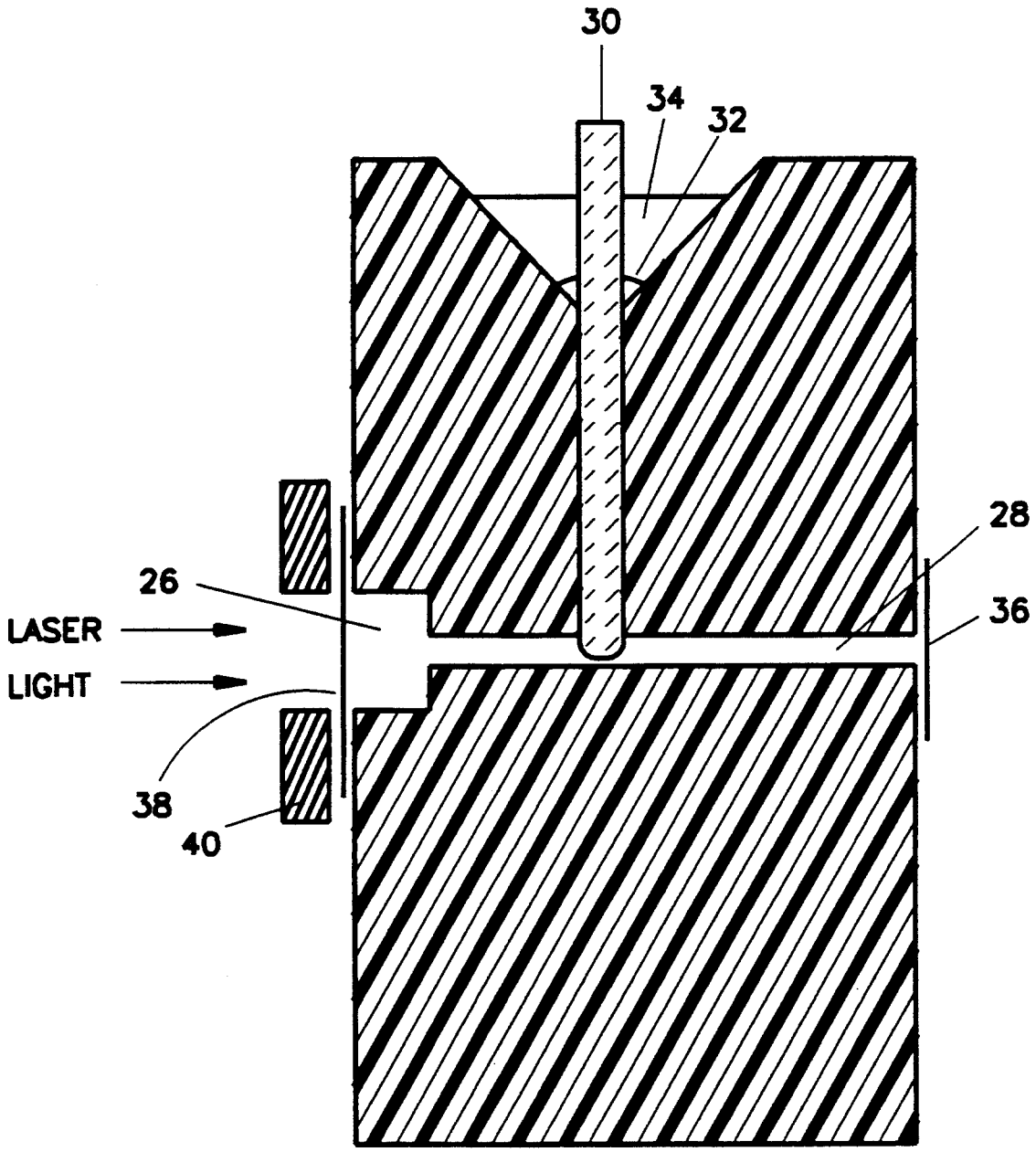
FIG. 2 is a cross sectional side view of a device for demonstrating the concept of the liquid propellant igniter.

FIG. 2 demonstrates the concept of the method for the liquid igniter. A demonstration device 24 shows that sufficient sealing of a primary chamber 26 can be achieved by cooling a portion of the liquid propellant therein. To show that this method is useful, it is only necessary to show that the propellant can be confined sufficiently to achieve the required pressurization. Once this has been shown, the temperature and orifice profile can be fine tuned for the optimum performance. For demonstration purposes only, the device 24 was made of a acrylic plastic material. However, the preferred choice is a metallic material such as high-strength stainless steel material having a high thermal conductivity characteristic. A 0.125 inch diameter hole 28 was drilled through the center of the device 24 in a horizontal direction to serve as part of the chamber 26. The length of the drilled hole was for convenience only; in a working device a much shorter hole would be advantageous. A 0.5-inch diameter, 0.125-inch deep chamber 26 was formed at one end of the drilled hole to serve as the area for the propellant to be ignited. Another hole was drilled from the top of the device 24 and a sapphire rod 30 was inserted in the hole. The rod 30 was sealed in place with an epoxy material 32, which flowed into a cone shaped reservoir 34 on the top of the device 24 to surround the rod 30. To perform the test, a piece of cellophane tape 36 which acts as a plug was placed over the drilled hole to keep the liquid from draining therefrom prior to cooling. The pressure retention of the tape 36 is negligible on the scale of pressures required to achieve propellant combustion. The drilled hole area was filled with the liquid propellant LGP 1846 (hydroxyl ammonium nitrate/triethanol ammonium nitrate/water). For safety during the tests, the chamber 26 was closed with five layers of 0.005 inch mylar film 38 which acts as a diaphragm, rather than use a high pressure window and risk rupture of device 24. In Applicant's laboratory it has been demonstrated that the diaphragm 38 reproducibly withholds pressures of at least 2,500 psi, and typically up to 3,500 psi. A holder 40 pushes the mylar diaphragm 38 against the device 24 to seal the chamber 26. The entire assembly is held in place by a clamp (not shown) to maintain sealing. With the chamber 26 and the deep chamber 28 filled with propellant, a few cubic centimeters of liquid nitrogen was introduced in the conical reservoir 34 around the sapphire rod 30. After a short period of time (less than one minute), a light pulse from a neodymium glass laser (1.05 micron wavelength, approximately 10 joules energy, 10 millisecond pulse length) was introduced into the chamber 26 through the area of the diaphragm 38. The laser beams are shown in FIG. 2 by a series of arrows penetrating against the diaphragm 38. The result was clear evidence of a successful ignition of the propellant which can happen under these conditions only with substantially complete confinement of the propellant. An ignition was signified by the high pressurization which burst the diaphragm 38 as evidenced by a sharp report and the observation of a hole in the diaphragm 38 after the test. The presence of gas phase combustive products was detected in the venting from the diaphragm 38. These gases include oxides of nitrogen which are easily detected by their characteristic odor and color. The geometry of the chamber 26 was chosen to duplicate that geometry which is known from studies in Applicant's laboratory to produce robust ignition under these conditions if confinement is present. The tape seal 36 was still intact. Thus the cooled propellant at the tip of the sapphire rod 30 was formed and acted as a sufficiently "solid plug" to contain the propellant during ignition. Under operational conditions, the mylar safety blow-out diaphragm 38 would not be present; the deep chamber 28 would allow the release of the pressure only through the hole past the tip of the cold sapphire rod 30. Thus, this demonstration shows that the method sufficiency confines the liquid to achieve full combustion; to make a fully operational device requires only optimization of orifice geometry and temperature.

Obviously, numerous modifications and variations of the present invention are possible in light of the above disclosure. It is therefore to be understood that the present invention can be practiced otherwise than as specifically described herein and still will be within the spirit and scope of the appended claims.

What is claimed is:

1. A method for confinement of a propellant during the initial stage of an ignition of a gun, comprising in combination, the following steps:

providing the propellant in a substantially closed chamber, a portion of the propellant being in a conduit exiting from the chamber, providing the ignition to the propellant, cooling the propellant portion in the exit conduit to a sufficiently low temperature for producing a substantially solidified condition to enhance the propellant containment, providing a closure means in the exit conduit to selectively vary the amount of flow thereby maintaining a relatively high temperature, and venting of the formed combustive products through the exit conduit whereby sufficient thermal energy is generated to sustain combustion and to ignite in the next stage.

2. A method as defined in claim 1 wherein the propellant is a liquid.

3. A method as defined in claim 1 wherein the propellant is a solid and an inert liquid is added for confinement.

4. A method as defined in claim 1 wherein the propellant is a liquidified solution of hydroxyl ammonium nitrate/triethanol ammonium nitrate.

5. A method as defined in claim 1 wherein the pressure during the ignition is above 1500 psi.

6. A method as defined in claim 1 wherein the ignition is accomplished by an electrical, pyrotechnic or laser irradiation means.

7. A method as defined in claim 1 wherein the cooling is accomplished by a cryogenic or thermoelectric means.

8. A method as defined in claim 1 wherein the cooling is accomplished by a sapphire rod inserted within the exit conduit.

9. A method as defined in claim 1 wherein the chamber is made of a high strength stainless steel having a high thermal conductivity characteristic.

10. A method for confinement of a gun propellant during the initial stage of ignition, comprising in combination the following steps:

providing a propellant in a substantially closed chamber, a portion of the propellant being in a conduit exiting from the chamber, providing the ignition to the propellant, applying an ignition stimulus to the propellant, cooling the propellant portion in the exit conduit to a sufficiently low temperature for producing a substantially solidified condition for the propellant containment, providing a closure means in the exit conduit to selectively vary the amount of flow whereby a relatively high temperature and pressure are reached, and venting of the formed combustion products through the exit conduit whereby sufficient thermal energy is generated to sustain combustion and to ignite in the next stage.

11. A method as defined in claim 10 wherein the propellant is a liquid.

12. A method as defined in claim 10 wherein the propellant is a solid and a liquid is added for confinement.

13. A method as defined in claim 10 wherein the propellant is a liquidified solution of hydroxyl ammonium nitrate/triethanol ammonium nitrate.

14. A method as defined in claim 10 wherein the pressure during the ignition is above 1500 psi.

15. A method as defined in claim 10 wherein the ignition is accomplished by an electrical, pyrotechnic, or laser irradiation means.

16. A method as defined in claim 10 wherein the cooling is accomplished by a cryogenic or thermoelectric means.

17. A method as defined in claim 10 wherein the cooling is accomplished by a sapphire rod inserted within the exit conduit.

18. A method as defined in claim 10 wherein the chamber is made of a high strength stainless steel having a high thermal conductivity characteristic.

19. A method for confinement of a gun propellant during the initial stage of ignition, comprising in combination the following steps:

providing a propellant of liquid and or liquidified solid material in a substantially closed chamber, a portion of the propellant being in a conduit exiting from the chamber, providing the ignition to the propellant, applying an ignition stimulus to the propellant, cooling the propellant in the exit conduit by a cryogenic or thermoelectric means to a sufficiently low temperature for producing a substantially solidified condition for the propellant containment, providing a closure means in the exit conduit to selectively vary the amount of flow thereby a relatively high temperature and pressure is maintained, and venting of the formed combustive products through the exit conduit whereby sufficient thermal energy is generated to sustain combustion and to ignite in the next stage.

20. A method as defined in claim 19 wherein the propellant is liquidified solution of hydroxyl ammonium nitrate/triethanol ammonium nitrate.

21. A method as defined in claim 19 wherein the pressure during the ignition is above 1500 psi.

22. A method as defined in claim 19 wherein the cooling is accomplished by a sapphire rod inserted within the exit conduit.

23. A method as defined in claim 19 wherein the chamber is made of A high strength stainless steel having a high thermal conductivity characteristic.

* * * * *